United States Patent [19]

Smedberg et al.

[11] Patent Number: 4,796,460

[45] Date of Patent: Jan. 10, 1989

[54] CUSHION CONSTRUCTION INCLUDING SNUBBER

[75] Inventors: Kenneth L. Smedberg, Crete; George J. Bozich, Chicago; Robert J. Kotynski, South Holland, all of Ill.

[73] Assignee: Kenneth L. Smedberg, Crete, Ill.

[21] Appl. No.: 55,687

[22] Filed: May 29, 1987

Related U.S. Application Data

[63] Continuation-in-part of Ser. No. 912,332, Sep. 26, 1986, Pat. No. 4,732,033.

[51] Int. Cl.[4] ..... B21D 24/02

[52] U.S. Cl. ..... 72/453.13; 72/344; 72/465; 267/119; 267/130; 100/259

[58] Field of Search ..... 72/350, 344, 453.13, 72/465, 344, 456, 455, 347; 267/199, 122, 130; 100/214, 259, 267

[56] References Cited

U.S. PATENT DOCUMENTS 3,130,962 4/1964 Stegner ..... 267/119
3,130,963 4/1964 Stegner ..... 267/119

FOREIGN PATENT DOCUMENTS 616266 6/1935 Fed. Rep. of Germany ..... 267/119
1130702 12/1984 U.S.S.R. ..... 267/119

*Primary Examiner*—David Jones
*Attorney, Agent, or Firm*—Anthony S. Zummer

[57] ABSTRACT

A die cushion construction for use in a press is the subject matter of the present invention. The instant die cushion construction includes a fixed plate connected to the press. A resilient cushion actuator has one end sealingly connected to the fixed plate. The resilient cushion actuator has an opposite end sealingly connected to a movable plate. The movable plate is adapted for connection to a portion of a die mounted in the press. A resilient snubber actuator has one end fixed relative to the fixed plate. The snubber actuator has an opposite movable end connected to the movable plate for affecting the rate of movement of the movable plate and a portion of the die. The snubber actuator is connected to means for allowing fluid to flow into the snubber actuator when the movable plate moves toward the snubber actuator.

15 Claims, 4 Drawing Sheets

CUSHION CONSTRUCTION INCLUDING SNUBBER

CROSS-REFERENCE TO RELATED APPLICATION

The instant application is a continuation-in-part of applicants' copending patent application entitled, "Pneumatic Die Cushion", Ser. No. 06/912,332, having a filing date of Sept. 26, 1986, now U.S. Pat. No. 4,732,033.

BACKGROUND OF THE INVENTION

Power presses are built in a wide variety of styles and sizes, and those presses have a variety of applications. In many applications, a press is used to operate at a high rate. The press moves quickly in its pressing stroke and moves at substantially the same rate in its return stroke. As is well known, die cushions are used as a work holding device or part ejector. The cushion which is used in certain instances includes a resilient bellows or actuator. The actuator receives a compressible fluid such as air so that the lower portion of the die may travel a selected distance with the ram during the pressing operation.

Once the actuator of the cushion is compressed, and the ram starts its return stroke, the cushion moves the movable portion of the die with it, disengaging the workpiece. The die cushion actuator moves the lower portion of the die with a constant acceleration until the movable portion of the lower die is at its rest position. The lower portion of the die is provided with a stop which causes an abrupt halt to the movement of the die. This abrupt halt causes an impact loading on that portion of the die connected to the cushion and associated parts. The repeated impact loading on the parts of the die often causes damage to those parts.

It is desirable to provide a die cushion construction for use in a press wherein the stopping of the die is not an abrupt stop but rather a substantially smooth stop which reduces damage to the die by impact loading on the die. This construction also reduces damage to the press and the die cushion itself.

SUMMARY OF THE INVENTION

The present invention relates to a die cushion construction for use in a power press. The die cushion includes a fixed plate connected to a base of the press. A resilient cushion bellows or actuator has one end sealingly connected to the fixed plate. The cushion actuator has an opposite end sealingly connected to a movable plate. The movable plate is adapted for connection to a portion of a die mounted in the press. A resilient snubber bellows or actuator has one end fixed relative to the fixed plate. The snubber actuator has an opposite movable end connected to a snubber movable plate. The snubber movable plate is connected to the first mentioned movable plate by a plurality of limiter rods. The snubber actuator affects the rate of movement of the cushion movable plate away from the snubber actuator. The snubber actuator has means for allowing fluid to flow into the snubber actuator when the cushion movable plate moves toward the snubber actuator.

DESCRIPTION OF THE PREFERRED EMBODIMENT

Figure 1:
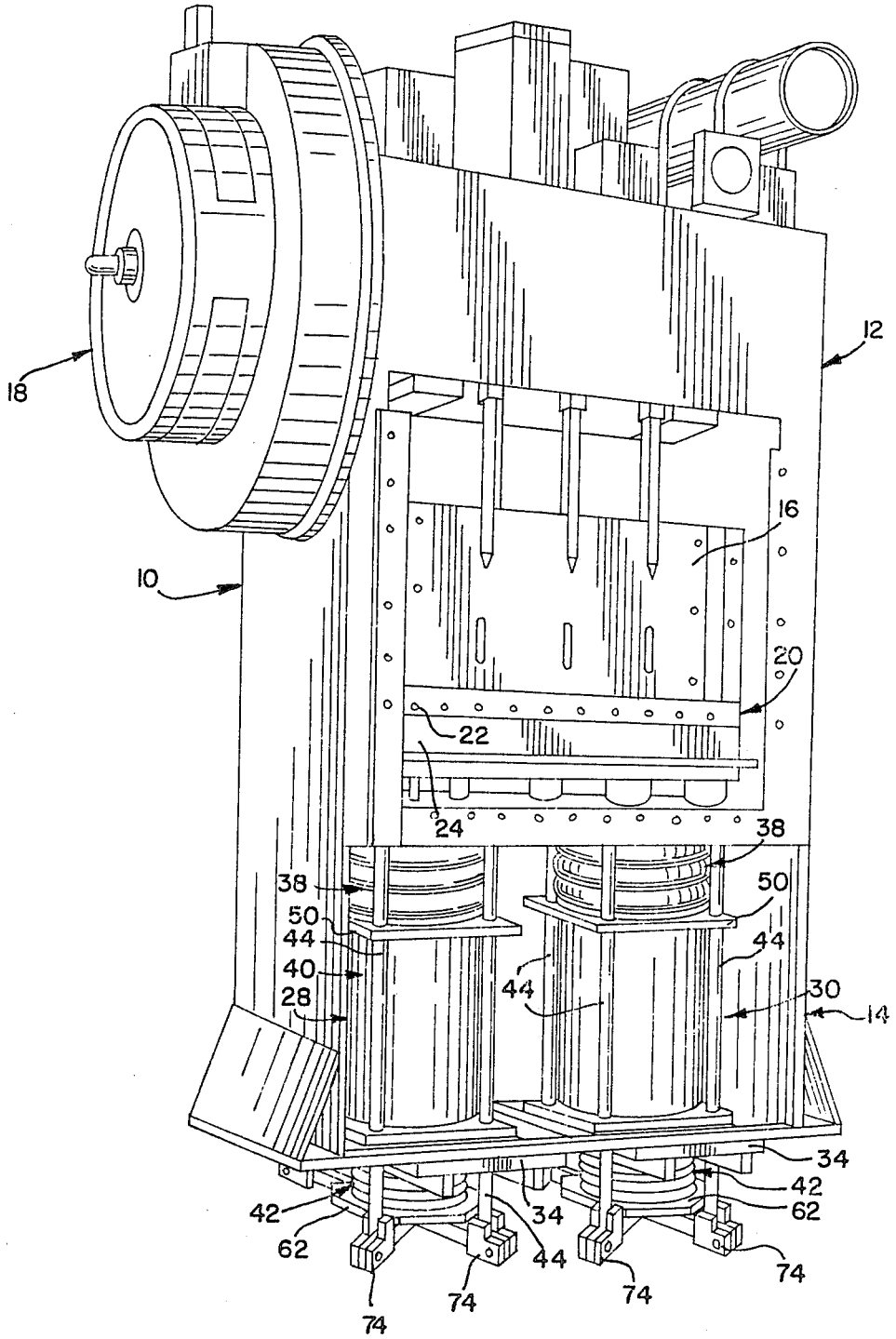
FIG. 1 is a perspective view of a conventional power press with a portion of the press and a supporting floor broken away in order to show mounted within the press a pair of die cushions, each having a construction embodying the herein disclosed invention.

Referring now to the drawings, a conventional power press 10 is shown in FIG. 1 with portions of the power press and supporting floor broken away in order to show specific embodiments of the present invention installed in the power press. The power press, as is conventional, generally includes a frame 12 mounted on a base 14 which is conventionally supported on a floor. A conventional ram 16 is movably mounted in the frame to move up and down. The ram is driven by a conventional drive assembly 18. A conventional die 20 is shown mounted in the press. Die 20 is shown solely for the purposes of illustration since the present invention is capable of being utilized with a wide variety of dies. Die 20 includes an upper or movable portion 22 which is connected to the ram to move up and down with the ram. Die 20 also includes a lower or substantially stationary portion 24 which is generally fixedly mounted in the press.

Figure 2:
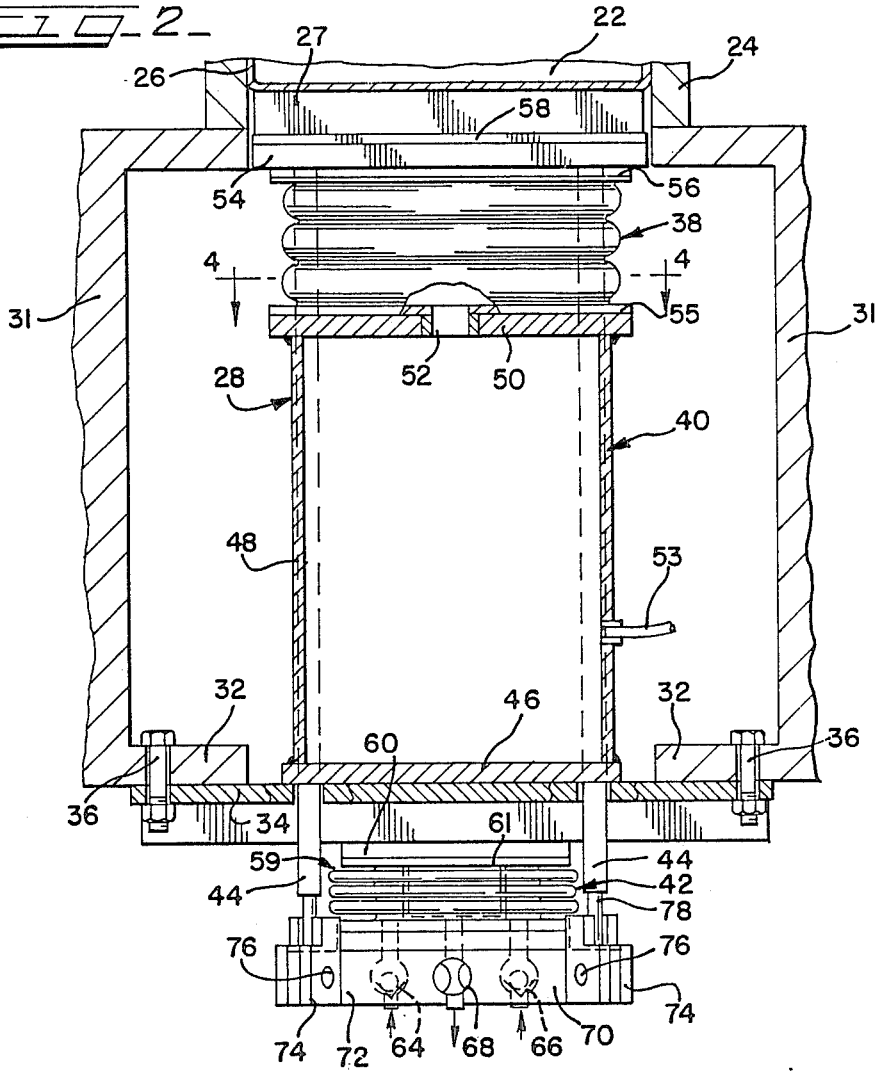
FIG. 2 is an enlarged partial cross sectional view of one of the die cushions shown in FIG. 1.
Figure 4:
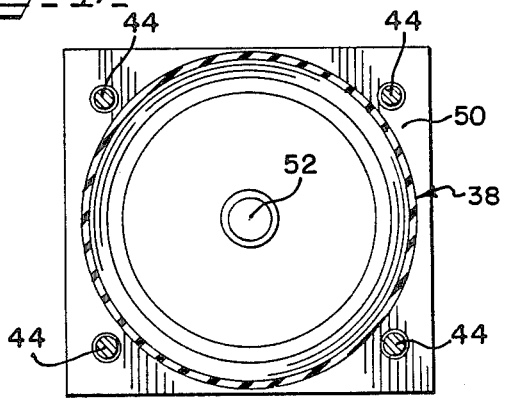
FIG. 4 is a cross sectional view taken on Line 4—4 of FIG. 2.
Figure 3:
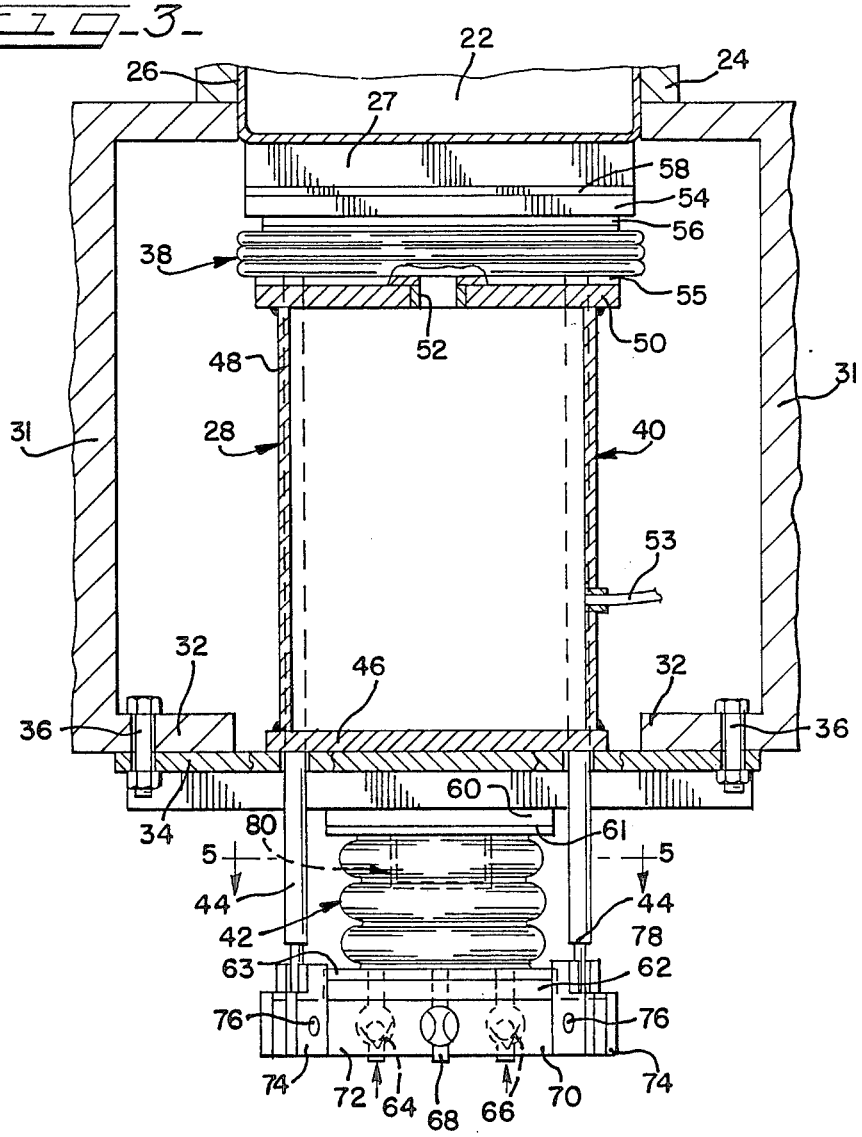
FIG. 3 is a cross sectional view similar to FIG. 2 but showing a cushion actuator in a substantially compressed state and a snubber actuator in a substantially extended attitude.
Figure 5:
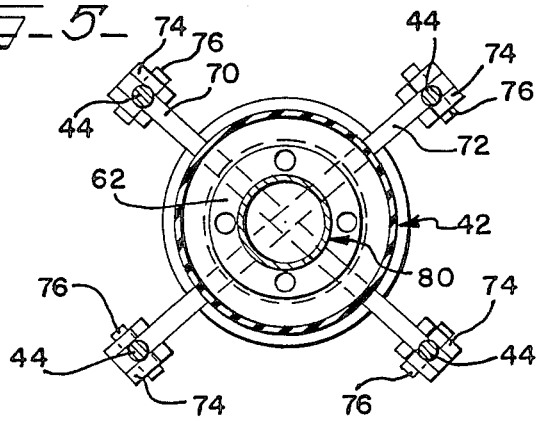
FIG. 5 is a cross sectional view taken on Line 5—5 of FIG. 3.
Figure 6:
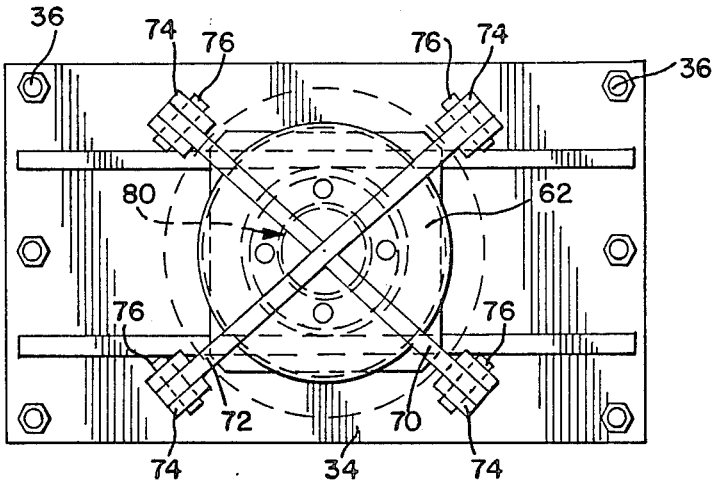
FIG. 6 is a bottom view of the die cushion of FIG. 2.
Figure 7:
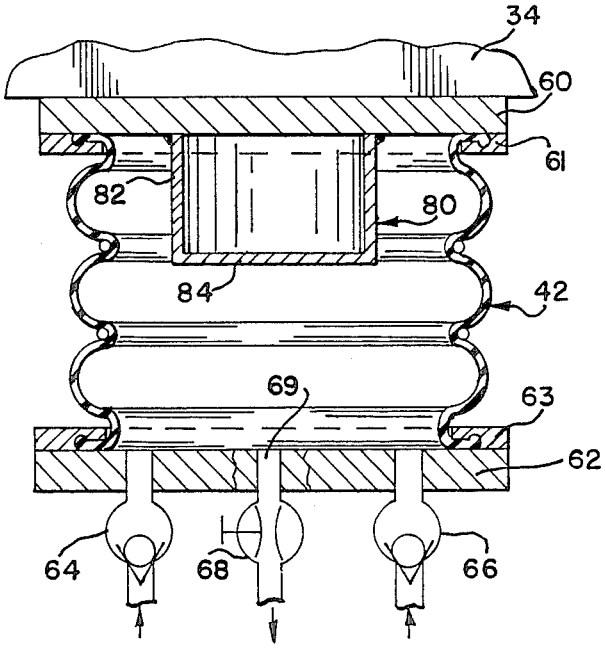
FIG. 7 is an enlarged cross sectional view of a snubber actuator showing a stop mounted within the snubber actuator.

Referring now to FIGS. 2 and 3, it may be seen that a metal blank or workpiece 26 is mounted in die 20 with the movable portion 22 positioned in a downward attitude in engagement with the blank or workpiece to form the workpiece as viewed in FIGS. 2 and 3. The lower portion of the die includes an ejector 27 which moves a selected distance with the workpiece and the movable portion of the die as is conventional.

A pair of identical die cushions 28 and 30 is mounted in base 14. Die cushions 28 and 30 are connected to ejector portion 27. Each of the die cushions 28 and 30 is a specific embodiment of the herein disclosed invention. The specific construction of die cushion 28 is described hereinafter. It being understood that the construction of die cushion 30 is identical to the construction of die cushion 28.

Base 14 of the power press includes a pair of side walls 31 which are not shown in FIG. 1 since they have been broken away in order to show better the installation of the subject die cushions. A mounting flange 32 is formed integral with side walls 31. A support beam 34 is secured to the mounting flange 32 by a plurality of conventional bolts 36. Die cushion 28 is mounted on support beam 34.

Die cushion 28 generally includes a conventional resilient bellows type cushion actuator 38 which is connected to ejector portion 27 of the die. A surge tank 40 is connected to cushion actuator 38. The surge tank supports actuator 38. The surge tank is mounted on support beam 34. A snubber actuator 42 which is a resilient bellows type actuator has one end fixed to the support beam and the other end is connected to a movable portion of actuator 38 through a plurality of identical limiter rods 44.

The surge tank is conventional in its construction in that it includes an end plate 46 which is fixed to support beam 34. Surge tank 40 includes a cylindrical side wall 48 which has one end welded to end plate 46. A fixed plate or port plate 50 is welded to the other end of cylindrical wall 48. Port plate 50 includes a port 52 to receive air from actuator 38. The surge tank is connected to a conventional and well known source of compressed air through a conventional conduit 53 in order to supply compressed air to the surge tank and actuator 38.

As was mentioned above, actuator 38 is a conventional resilient bellows type actuator which has one end sealingly fixed to fixed plate or port plate 50 by a conventional sealing plate 55. A movable plate or mounting plate 54 is sealingly connected to the other end of the actuator by a sealing connector plate 56 as is conventional. A striker plate 58 is secured to mounting plate 54 in a customary manner by conventional fasteners which are not shown herein. Ejector portion 27 is secured to striker plate 58 as is conventional.

A snubber assembly 59 is mounted below the support beam and is connected to movable plate 54 by means of the rods 44. The snubber assembly includes a head plate 60 fixed to the support beam 34 and in turn to fixed plate 50 through the surge tank. The snubber actuator which is part of the snubber assembly has one end sealingly fixed to head plate 60 by a snubber head sealing plate 61. Snubber actuator 42 has its other end sealingly connected to a movable snubber port plate 62 by a lower sealing plate 63. The snubber port plate 62 has a pair of one-way valves 64 and 66 mounted thereon. The one-way valves 64 and 66 communicate with the interior of the snubber actuator 64 so that as snubber actuator 42 is expanded, air is drawn into the interior of the actuator through the one-way valves. A variable rate valve 68 is also mounted in the snubber port plate 62 and communicates with the interior of snubber actuator 42 through a port 69.

The snubber port plate 62 is mounted on a pair of intersecting support bars 70 and 72. A clevis 74 is mounted on the end of each of the support bars 70 and 72. Each of the limiter rods 44 is connected to each clevis 74 by a pivot pin 76. Each of the rods 44 has a conventional threaded interconnector end portion 78 which allows the length of each of the rods to be adjusted. By appropriate adjustment of the length of rods 44, the snubber port plate 62 may be positioned parallel to movable plate 54 so that parallel positioning of upper and lower mechanisms are maintained. Each of the rods 44 has its other end fixed to the movable plate 54 so that the free end of the snubber actuator moves with the movable plate.

The snubber assembly includes a stop 80 mounted on head plate 60 inside of snubber actuator 42. The stop includes a cylindrical side wall 82 with a stop plate 84 formed integral with the side wall. The cylindrical side wall is sealingly welded to head plate 60 so that air may not enter or leave the interior of stop 80. The stop provides a means for limiting movement of port plate 62 toward head plate 60 and thereby movement of movable plate 54 away from the snubber assembly.

The instant die cushions 28 and 30 are particularly effective for use in a high speed power press. Typically, in a high speed power press, ram 16 moves up and down at a quick rate. With the use of the subject die cushions, the impact loading on the lower portion of the die is substantially reduced. Ram 16 moves upper portion 22 of the die downward to engage workpiece 26 and with it ejector portion 27 of the lower portion of the die. The downward movement of the ram pushes mounting plate 54 downward to compress the cushion actuator. The compression of the cushion actuator acts to compress the air within the cushion actuator and to force some of the air into the surge tank through port 52. The compression of the cushion actuator applies a resistant force to a tooling workpiece connected to the ram to allow the workpiece to be drawn as is conventional.

As the cushion actuator is compressed, the snubber assembly is also placed into operation. As mounting plate 54 moves toward the snubber assembly, limiter rods 44 move snubber port plate 62 away from the snubber head plate and thereby extend the snubber actuator. As the snubber actuator is extended, air is drawn into the snubber actuator through one-way valves 64 and 66 and through variable rate valve 68.

At the end of the ram's stroke, the ram is raised upward and raises with it upper portion 22 of the die. The ram is powered upward and moves quickly whereas the ejector portion 27 of the die is moved by the compressed air contained in the cushion actuator and in the surge tank. The inertia of the parts causes portion 27 to move slower than the ram so that movable portion 22 disengages workpiece 26. The force of the compressed fluid in the cushion actuator tends to accelerate continuously the rate of movement of the movable plate away from the snubber. However, the air contained in the snubber actuator becomes compressed and provides a resistance to the acceleration of the movable plate away from the snubber. Thus, there is a restrained movement of the movable plate as the plate reaches its return position without a high impact loading on the lower portion of the die. The compressed air in the snubber actuator may not exit through the two one-way valves leaving only port 69 connected to variable rate valve 68 as the means for exit. The exiting of the air through the variable rate valve provides a control for the rate of movement of the mounting plate away from the snubber assembly to its original position. The rate of flow of fluid through valve 68 is adjustable to adjust the rate of return of the ejector position to adjust the snubbing of the cushion for various speeds of operation. Stop 80, built into the snubber, acts as a stop within the snubber actuator.

Stop 80 serves a dual function in that it serves as a mechanical stop at the end of the stroke of the snubber actuator. The second function which is serves is to provide a volume reducer for the snubber actuator at the end of the stroke. It may be appreciated that as the snubber port plate moves toward head plate 60, the volume within the actuator reduces; however, as the port plate approaches stop plate 84 of the stop, the amount of volume reduction within the snubber actuator increases at an ever-increasing rate thereby causing a buildup of pressure within the actuator at a greater rate to increase the force restraining the cushion actuator. The restraint of the cushion actuator causes the mounting plate to come to a relatively smooth stop, thereby further protecting the die connected to the mounting plate from a high impact loading.

Although the instant die cushions have been shown with a surge tank, it is readily apparent that the cushion actuator may be used without a surge tank in certain applications.

The instant invention has been described in detail and shown in detail in the accompanying drawings. It is to be expressly understood that the subject invention is limited only by the appended claims, and those skilled in the art may make various modifications and changes in the die cushion disclosed herein without departing from the spirit and scope of the present invention.

We claim:

1. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubbr actuator having one end fixed relative to the fixed plate, said snubber actuator having an opposite movable end connected to the movable plate for affecting the rate of movement of the movable plate, a plurality of rods connecting the movable plate with the movable end of the snubber actuator, and means for allowing fluid to flow into the snubber actuator when the movable plate of the cushion moves toward the snubber actuator.

2. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having opposite movable end connected to the movable plate for affecting the rate of movement of the movable plate, a plurality of rods, each of said rods having one end connected to the movable plate, each of said rods having an opposite end connected to the movable end of the snubber actuator, selected rods of the plurality of rods each having adjustment means for adjusting selectively the length of each of the selected rods to adjust the spatial relationship between the movable plate and the movable end of the snubber actuator, and means for allowing fluid to flow into the snubber actuator when the movable plate of the cushion moves toward the snubber actuator.

3. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, a volume reducer mounted within the snubber actuator and connected to the fixed plate for increasing the rate of reduction of volume within the snubber actuator as the movable end of the snubber actuator moves toward the fixed end, and means for allowing fluid to flow into the snubber actuator when the movable plate of the cushion moves toward the snubber actuator.

4. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, and a volume reducer mounted within the snubber actuator and connected to the fixed plate, said volume reducer limiting movement of the movable end of the snubber actuator toward the fixed plate and increasing the rate of reduction of volume within the snubber actuator as the movable end of the snubber actuator moves toward the fixed end.

5. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, a plurality of rods connecting the movable plate with the movable end of the snubber actuator, and means for allowing fluid to flow out of the snubber actuator when the cushion movable plate moves away from the snubber actuator moving the movable end of the snubber toward the fixed end of the snubber actuator.

6. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cusion moves toward the snubber actuator, means for allowing fluid to flow out of the actuator when the cushion movable plate moves away from the snubber actuator, and a surge tank having one end fixed to the fixed plate and the opposite end fixed to the fixed end of the snubber actuator, said surge tank being connected to the resilient actuator of the cushion to receive fluid from the resilient actuator of the cushion.

7. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, a plurality of rods connecting the cushion movable plate with the movable end of the snubber actuator, means for allowing fluid to flow out of the snubber actuator when the cushion movable plate moves away from the snubber actuator, and adjustable valve means for selectively controlling the rate of fluid flow out of the snubber actuator to regulate selectively the rate of movement of the movable plate away from the snubber actuator.

8. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, a plurality of rods, each of said rods having one end connected to the cushion movable plate, each of said rods having an opposite end connected to the movable end of the snubber actuator, selected rods of the plurality of rods each having adjustment means for adjusting selectively the length of each of the selected rods to adjust the spatial relationship between the cushion movable plate and the movable end of the snubber actuator; means for allowing fluid to flow out of the snubber actuator when the movable plate moves away from the snubber actuator; and adjustable valve means for selectively controlling the rate of fluid flow out of the snubber actuator to regulate selectively the rate of movement of the movable plate away from the snubber actuator.

9. A die cushion construction for use in a press, said cushion construction having a fixed plate connected to a base of the press, a resilient actuator having one end sealingly connected to the fixed plate, said actuator having an opposite end connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, a surge tank having one end fixed to the fixed plate and an opposite end fixed to the fixed end of the snubber actuator, said surge tank being connected to the cushion actuator allowing fluid to flow between the surge tank and the interior of the cushion actuator, means for allowing fluid to flow out of the snubber actuator when the cushion movable plate moves away from the snubber actuator, and adjustable valve means for selectively controlling the rate of fluid flow out of the snubber actuator to regulate selectively the rate of movement of the cushion movable plate away from the snubber actuator.

10. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, said means for allowing fluid to flow into the snubber actuator includes a one-way valve allowing fluid to enter the snubber actuator through the one-way valve but not leave the snubber actuator through the one-way valve, a plurality of rods connecting the cushion movable plate with the movable end of the snubber actuator, means for allowing fluid to flow out of the snubber actuator when the cushion movable plate moves away from the snubber actuator, and selectively adjustable valve means for selectively controlling the rate of fluid flow out of the snubber actuator to regulate selectively the rate of movement of the cushion movable plate away from the snubber actuator.

11. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, said means for allowing fluid to flow into the snubber actuator includes a one-way valve allowing fluid to enter the snubber actuator through the one-way valve but not leave the snubber actuator through the one-way valve, means for allowing fluid to flow out of the snubber actuator when the cushion movable plate moves away from the snubber actuator; a plurality of rods, each of said rods having one end connected to the cushion movable plate, each of said rods having an opposite end connected to the movable end of the snubber actuator, selected rods of the plurality of rods each having adjustment means for adjusting selectively the length of each of the selected rods to adjust the spatial relationship between the cushion movable plate and the movable end of the snubber actuator; and adjustable valve means for selectively controlling the rate of fluid flow out of the snubber actuator to regulate selectively the rate of movement of the cushion movable plate away from the snubber actuator.

12. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow out of the snubber actuator when the cushion movable plate moves away from the snubber actuator, valve means for selectively controlling the rate of flow of fluid out of the snubber actuator to regulate selectively the rate of movement of the cushion movable plate away from the snubber actuator, means for allowing fluid to flow into the snubber actuator when the movable plate of the cushion moves toward the snubber actuator, said means for allowing fluid to flow into the snubber actuator including a one-way valve allowing fluid to enter the snubber actuator through the one-way valve but not leave the snubber actuator through the one-way valve, and a volume reducer mounted within the snubber actuator and connected to the fixed plate, said volume reducer limiting movement of the movable end of the snubber actuator toward the fixed plate and increasing the rate of reduction of volume within the snubber actuator as the movable end of the snubber actuator moves toward the fixed end.

13. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, said means for allowing fluid to flow into the snubber actuator includes a one-way valve allowing fluid to enter the snubber actuator through the one-way valve but not leave the snubber actuator through the one-way valve, a surge tank having one end fixed to the fixed plate and an opposite end fixed to the fixed end of the snubber actuator, said surge tank connected to the resilient cushion actuator to allow fluid to flow between the cushion actuator and the surge tank; means for allowing fluid to flow out of the snubber actuator when the cushion movable plate moves away from the snubber actuator; and a selectively adjustable valve for selectively controlling the rate of fluid flow out of the snubber actuator to regulate selectively the rate of movement of the cushion movable plate away from the snubber actuator.

14. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, said means for allowing fluid to flow into the snubber actuator includes a one-way valve allowing fluid to enter the snubber actuator through the one-way valve but not leave the snubber actuator through the one-way valve, a surge tank having one end fixed to the fixed plate and an opposite end fixed to the fixed end of the snubber actuator, said surge tank being connected to the cushion actuator to allow fluid to flow between the cushion actuator and the surge tank; a plurality of elongated rods, each of said rods having one end connected to the cushion movable plate, each of said rods having an opposite end connected to the movable end of the snubber actuator, selected rods of the plurality of rods each having adjustment means for adjusting selectively the length of each of the selected rods to adjust the spatial relationship between the plate and the movable end of the snubber actuator; means for allowing fluid to flow out of the snubber actuator when the cushion movable plate moves away from the snubber actuator; and an adjustable valve for selectively controlling the rate of fluid flow out of the snubber actuator to regulate selectively the rate of movement of the cushion movable plate away from the snubber actuator.

15. A die cushion construction for use in a press, said cushion construction having a fixed plate connected to a base of the press, a resilient actuator having one end sealingly connected to the fixed plate, said actuator having an opposite end sealingly connected to a movable plate, said movable plate connected to a portion of a die in the press, the improvement comprising; a resilient snubber actuator having one end fixed relative to the fixed plate, said snubber actuator having an opposite movable end connected to the movable plate for affecting the rate of movement of the movable plate, means for allowing fluid to flow into the snubber actuator when the movable plate of the cushion moves toward the snubber actuator, said means for allowing fluid to flow into the snubber actuator includes a one-way valve allowing fluid to enter the snubber actuator through the one-way valve but not leave the snubber actuator through the one-way valve, a surge tank having one end fixed to the fixed plate and an opposite end fixed to the fixed end of the snubber actuator, said surge tank being connected to the cushion actuator to allow fluid to flow between the cushion actuator and the surge tank; a pluarlity of elongated rods, each of said rods having one end connected to the cushion movable plate, each of said rods having an opposite end connected to the movable end of the snubber actuator, selected rods of the plurality of rods each having adjustment means for adjusting selectively the length of each of the selected rods to adjust the spatial relationship between the plate and the movable end of the snubber actuator; a volume reducer mounted within the snubber actuator and connected to the fixed plate, said volume reducer limiting movement of the movable end of the snubber actuator toward the fixed plate and increasing the rate of reduction of volume within the snubber actuator as the movable end of the snubber actuator moves toward the fixed end; means for allowing fluid to flow out of the snubber actuator when the cushion movable plate moves away from the snubber actuator; and an adjustable valve for selectively controlling the rate of fluid flow out of the snubber actuator to regulate selectively the rate of movement of the cushion movable plate away from the snubber actuator.

* * * * *